US010143289B2

(12) United States Patent
Sucich et al.

(10) Patent No.: US 10,143,289 B2
(45) Date of Patent: Dec. 4, 2018

(54) EYELINER PENCIL

(71) Applicants: Valerie Jo Sucich, Lowell, IN (US); Cody Sucich, Lowell, IN (US); Anthony Richard Sucich, Lowell, IN (US)

(72) Inventors: Valerie Jo Sucich, Lowell, IN (US); Cody Sucich, Lowell, IN (US); Anthony Richard Sucich, Lowell, IN (US)

( * ) Notice: Subject to any disclaimer, the term of this patent is extended or adjusted under 35 U.S.C. 154(b) by 330 days.

(21) Appl. No.: 15/076,013

(22) Filed: Mar. 21, 2016

(65) Prior Publication Data

US 2017/0265621 A1 Sep. 21, 2017

(51) Int. Cl.
*A45D 40/20* (2006.01)

(52) U.S. Cl.
CPC ..... *A45D 40/205* (2013.01); *A45D 40/20* (2013.01); *A45D 2040/204* (2013.01); *A45D 2200/1072* (2013.01)

(58) Field of Classification Search
CPC ..... A45D 40/20; A45D 40/205; A45D 2040/204; A45D 2040/208
See application file for complete search history.

(56) References Cited

U.S. PATENT DOCUMENTS

| | | | | | |
|---|---|---|---|---|---|
| 4,820,070 | A * | 4/1989 | Spatz | A45D 40/06 | 401/68 |
| 5,407,286 | A * | 4/1995 | Powers | A45D 40/04 | 401/68 |
| 5,423,623 | A * | 6/1995 | Bakic | A45D 40/04 | 401/68 |
| 5,879,093 | A * | 3/1999 | Ohba | A45D 40/04 | 401/68 |
| 6,071,027 | A * | 6/2000 | Gueret | A45D 40/04 | 401/68 |
| 6,293,719 | B1 * | 9/2001 | Ohba | A45D 40/04 | 401/59 |
| 8,534,946 | B2 * | 9/2013 | Cont | A45D 40/205 | 401/68 |

* cited by examiner

*Primary Examiner* — Ryan A Reis

(57) ABSTRACT

The present invention relates to a multi-purpose makeup applicator that comprises, a pencil body having a first body half and a second body half, a refill cavity formed within an encircled sidewall of the first body half, a helix cavity formed within an encircled sidewall of the second body half where the refill cavity and helix cavity are separated by a cavity partition, a lid hingedly attached to the first half of the body and terminates prior to the cavity partition where the second half of the body originates, a displacement mechanism located is configured in the helix cavity of the second body half. In the open position of the lid, a refill cartridge can be placed in the refill cavity, and through the displacement mechanism the refill cartridge moves operably relative to and from the refill cavity of the body.

20 Claims, 4 Drawing Sheets

EYELINER PENCIL

FIELD OF THE INVENTION

The present invention relates generally to a cosmetic tool for applying makeup, more particularly, to an apparatus and method of use for a refillable eyeliner/cosmetic pencil with enhanced properties.

BACKGROUND OF THE INVENTION

The industries relating to personal style and fashion are constantly growing and evolving. People are continually striving to create and maintain their personal look, style, and identity while keeping in tune with the latest trends as they hit the fashion scene. Among the many facets of which these multimillion dollar trades are comprised, the field of health and beauty care which includes makeup products is perhaps the largest and most regarded. A trip down the cosmetic isle of any store allows one to quickly realize the hundreds, if not thousands, of products available for use. One common aspect of almost all makeup products is that the cost and volume of packaging and retail material outweigh that of the actual product itself. One product that possesses this trait prominently is that of the eyeliner pencil.

Conventional cosmetic pencils include a wooden shaft having an elliptic, or oval-shaped, longitudinally extending channel filled with a cosmetic core. Following sharpening, a smooth continuous inwardly tapering cosmetic core tip is formed terminating at a curved edge as seen in US Patent Application No. 20040175223.

All of the associated packaging and material enclosure is simply discarded when the product is consumed. This not only represents a large manufacturing cost, but contributes to excess material in our landfills and recycling centers.

Accordingly, there exists a need for a means by which eyeliner containers packaging modified to address the above mentioned concerns. The development of the eyeliner pencil with refillable cartridge fulfills this need.

OBJECT OF INVENTION

The principal object of the invention herein is to provide a new and enhanced eyeliner pencil with refillable mechanism, where the cartridge is totally consumed it can be replaced by a refill cartridge by the user.

Another object of the present invention is to provide commercially available refill cartridge of a consistency or color as may suit the taste and needs of a user.

It is another object of the present invention to provide cosmetic enhancement of anatomical features such as face, lips, eyes.

SUMMARY OF THE INVENTION

The present invention relates to a multi-purpose makeup applicator that comprises, a pencil body having a first body half and a second body half, a refill cavity formed within an encircled sidewall of the first body half, a helix cavity formed within an encircled sidewall of the second body half where the refill cavity and helix cavity are separated by a cavity partition, a lid hingedly attached to the first half of the body and terminates prior to the cavity partition where the second half of the body originates, a displacement mechanism located is configured in the helix cavity of the second body half. In the open position of the lid, a refill cartridge can be placed in the refill cavity, and through the displacement mechanism the refill cartridge moves operably relative to and from the refill cavity of the body.

These and other features of the present invention will become readily apparent upon further review of the following specification and drawings. Other goals and advantages of the invention will be further appreciated and understood when considered in conjunction with the following description and accompanying drawings. While the following description may contain specific details describing particular embodiments of the invention, this should not be construed as limitations to the scope of the invention but rather as an exemplification of preferable embodiments. For each aspect of the invention, many variations are possible as suggested herein that are known to those of ordinary skill in the art. A variety of changes and modifications can be made within the scope of the invention without departing from the spirit thereof.

BRIEF DESCRIPTION OF THE DRAWINGS

In the accompanying figures, similar reference numerals may refer to identical or functionally similar elements. These reference numerals are used in the detailed description to illustrate various embodiments and to explain various aspects and advantages of the present disclosure.

DETAILED DESCRIPTION OF THE INVENTION

Figure 1:
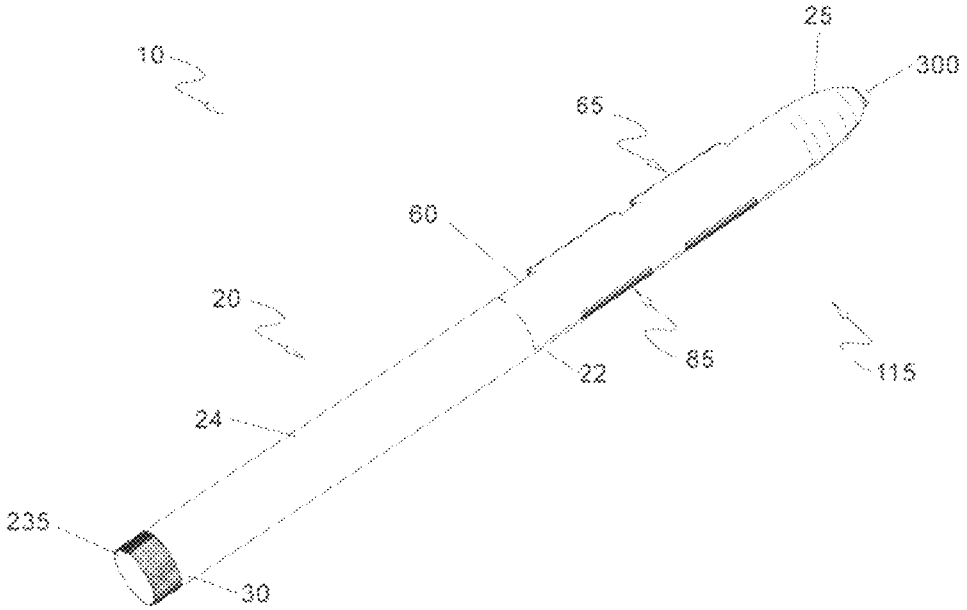
FIG. 1 is an isometric view of an pencil in accordance with the preferred embodiment of the present invention.

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present invention describes an eyeliner and lip liner pencil (herein referred to as the "multipurpose makeup applicator") 10, which provides a means to hold and apply cosmetic enhancements to various facial features, such as eyes and lips, utilizing any commercially available refill cartridge 300 of a consistency or color as may suit the taste and needs of a user. The multipurpose makeup applicator 10 includes a displacement mechanism 200 which selectively allows a user to extend the refill cartridge 300 from the tip 25 of the body 20 for the normal wear, or inadvertent breakage of the refill cartridge 300 during use and can retract the refill cartridge 300 for storage upon completion of use.

As stated previously, the multipurpose makeup applicator 10 is primarily intended for the cosmetic enhancement of anatomical features. However, there should be no implied limitation to those specific features as elaborated, or to any utility application as is conceivable, so as to limit the scope of the multipurpose makeup applicator 10.

FIG. 1 illustrates an isometric view of the multipurpose makeup applicator 10. The multipurpose makeup applicator 10 includes a generally cylindrical body 20 and a lid 60. The body 20 is composed of a plurality of molded thermoplastic parts and as such may be presented in a wide variety of colors and surface textures to suit the taste of a user. It is understood that other materials, such as cast metals, or formed composites, or other cross-sectional shapes, may be utilized without limiting the scope of the multipurpose makeup applicator 10. Furthermore, the exterior surface, or any portion thereof, may be provided with any additional texturing, embossments, or decorations of any style, such as ribs, annular ridges, lettering, or the like, without limiting the scope or teachings of the multipurpose makeup applicator 10 now or at any time in the future.

The body 20 is comprised of a first body half 22, a second body half 24, and a lid 60. The first body half 22 is configured to be a longitudinal half of the body 20 extending from a tip 25 at a first, or anterior, end to a tail 30 at an opposite, or posterior, end. The lid 60 is a longitudinal half of a first end of the body 20 extending from the tip 25 to approximately midway along the length of the multipurpose makeup applicator 10 and attached to the body 20 by means of interconnected hinge 65 components. At least one latch 85 is disposed along an exterior face of the body 20 opposite from the hinges 65 to retain the lid 60 in a closed position 115. The second body half 24 is configured to be a longitudinal portion, complimentary to a posterior portion of the first body half 22, extending from a midpoint of the body 20 to the tail 30. The second body half 24 is attached to the first body half 22, with alignment at the tail 30, by means of a thermoforming process, or by an appropriate thermoplastic adhesive material or solution or combination thereof. A knob journal 190 (shown in the FIG. 2B) is centrally located in the tail 30 of the combined body halves 22, 24. The knob journal 190 (shown in the FIG. 2B) is an aperture into which a knob 235 is inserted and retained. The anterior end of the body 20 is provided with a parabolic tip 25, encompassing the first body half 22 and the lid 60 through which the refill cartridge 300 is configured to extend for use. In other embodiments, the tip 25 may be conical, or hemispherical, or any combination thereof as may suit the taste of a user, or the convenience of manufacturing.

Figure 2A:
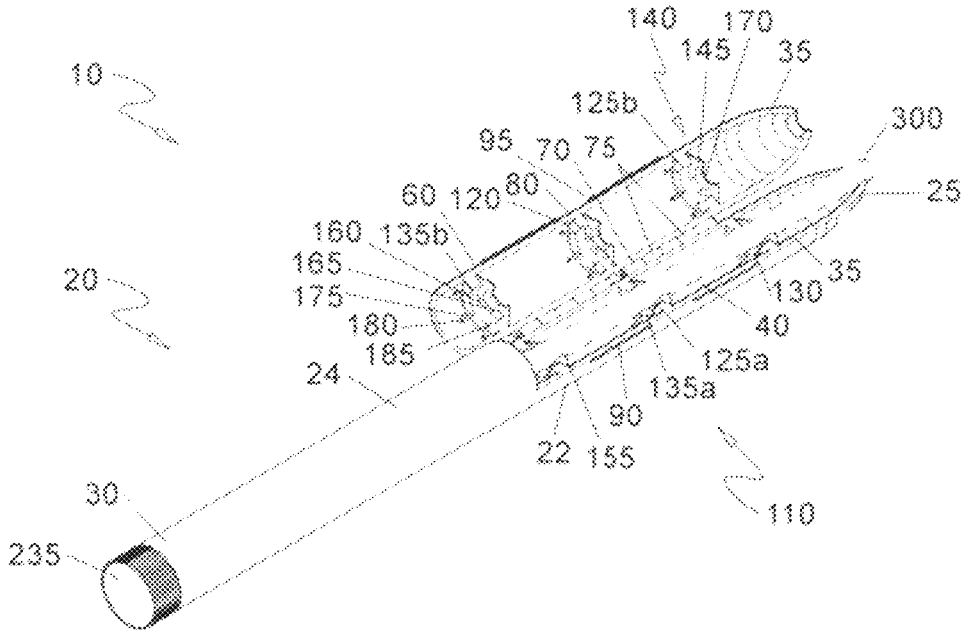
FIG. 2A illustrates an isometric view of the pencil in an open position in accordance with the preferred embodiment of the present invention.
Figure 2B:
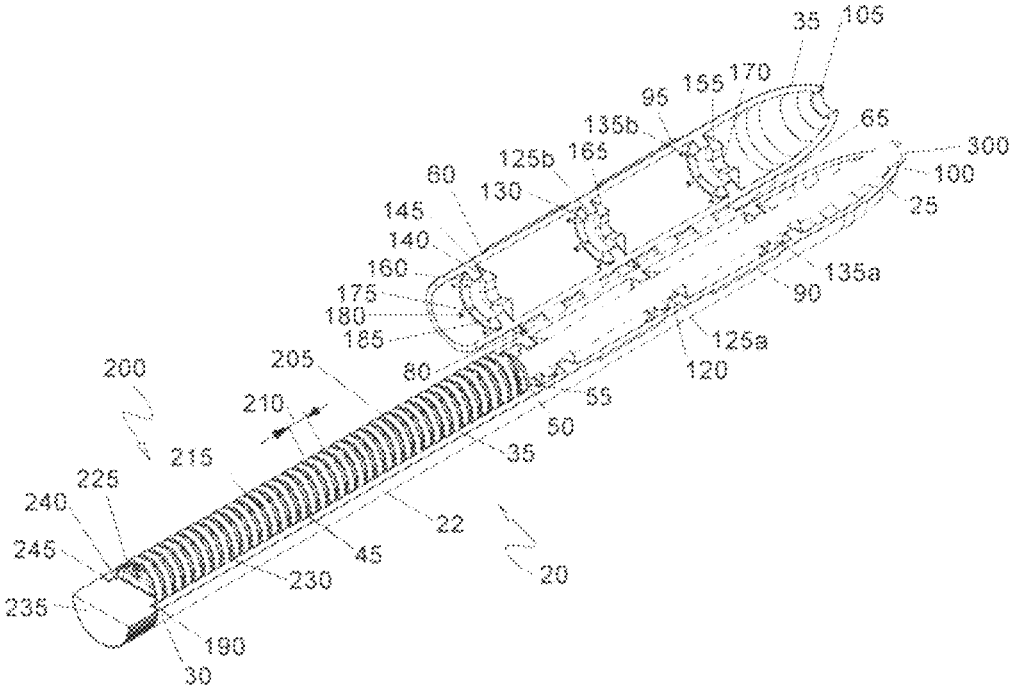
FIG. 2B illustrates an isometric view of the pencil in an open position with an internal displacement mechanism in accordance with the preferred embodiment of the present invention.

FIG. 2A and FIG. 2B are the isometric views of the multipurpose makeup applicator 10 in open position 110 in accordance with the preferred embodiment of the present invention. In normal use, the multipurpose makeup applicator 10 is configured to be in the closed position 115. A user detaches the second catches 95 from the first catches 90, where the latch 85 is configured to be a second catch 95 projecting from the edge of the lid 60 which envelops and interferes with a first catch 90 projecting from the sidewall 35 of the first body half 22 and the user pivots the lid 60 about the hinge pin(s) 80 in order to configure the device to an open position 110, as seen, in order to selectively insert, or remove, a refill cartridge 300 from the multipurpose makeup applicator 10. The body 20 has an encircling sidewall 35 forming a refill cavity 40 and a helix cavity 45 separated by a cavity partition 50. The cavity partition 50 is located in proximity to the longitudinal midpoint of the body 20 and forms a rear barrier to the refill cavity 40 and a forward barrier to the helix cavity 45. The lid 60 terminates prior to the cavity partition 50, whereupon the second body half 24 commences. A cavity partition aperture 55 is centrally disposed in the cavity partition 50 so that the refill cavity 40 and the helix cavity 45 are in communication. The refill cavity 40, by virtue of existing between the lid 60 and the anterior of the first body half 22, is thus equally divided. The anterior end of the body first half 22 is provided with a tip aperture first segment 100 is configured to be a groove in the sidewall 35 of the tip 25. A similar tip aperture second segment 105 is disposed in the anterior end of the lid 60. When the multipurpose makeup applicator 10 is configured to be in the closed position 115, as depicted in FIG. 1, the tip aperture segments 100, 105 align to form a circular opening in the tip 25 through which a cylindrical refill cartridge 300 can project.

The refill cavity 40, as previously stated, is the interior space encompassed by the anterior portion of the first body half 22 and the lid 60. Disposed within the refill cavity 40 is a plurality of rod support partitions 120. The rod support partitions 120 are configured to be structural bulkheads provided with a support partition aperture 130 through which a cylindrical push rod 215 may be extended to advance the refill cartridge 300. The push rod 215 extends 25 from the helix cavity 45 through the cavity partition aperture 55 as shown in FIG. 2B. A first wall member 125*a*, laterally spanning that portion of the semicircular refill cavity 40 located in the first body half 22 is placed in concurrence with a similarly configured second wall member 125*b* located in the lid 60 to form the complete rod support partition 120 when the device is placed in a closed position 115. In a like manner, an aperture first half 135*a* is configured to be a semicircular groove in the first wall member 125*a* and an aperture second half 135*b* is disposed in the second wall member 125*b*. The closure of the lid 60 against the body first half 22 completes each rod support partition 120 with a circular support partition aperture 130. The purpose for the rod support partitions 120 in the refill cavity 40 is to obviate any lateral displacement of the push rod 215 as the push rod 215 is being extended through the refill cavity 40.

A cartridge support partition 130 is located at an anterior face of each rod support partition 120. While the rod support partition 120 functions to align and support the push rod 215 through the refill cavity 40, the cartridge support partitions 130 serve to support and align the smaller diameter refill cartridge 300 in the refill cavity 40. However, due to this smaller cross section of the refill cartridge 300 in comparison to the push rod 215, the cartridge support partitions 130 are configured to be divided into a plurality of movable segments 145 so as to be temporarily displaced as the push rod 215 traverses the refill cavity 40. The moveable segments 145 are composed of the same constituent material as the body 20 with a planar rear face 160 in contact with the cartridge support partition 130, an arcuate groove 165 formed along a perpendicular face directed toward the center of the refill cavity 40, and an angularly curved clearance face 155.

A return spring 175 is attached at a first end to the rear face 160 of each moveable segment 145 to exert a righting force when the push rod 215 is retracted into the helix cavity 45. The return spring 175 is configured to be a resilient elastomeric filament which, in a contracted state, retains the rear face 160 in contact with the rod support partition 120. The return spring 175 is routed through a spring aperture 185 cut, or formed, into the rod support partition 120 and anchored at a second end to the respective proximate sidewall 35 by means of a restrictive stay 180 as illustrated. The stay 180 is configured to be a pair of internal projections of the sidewall 35 in sufficiently close proximity to each other that a retentive constrictive force is placed on the return spring 175.

Figure 3A:
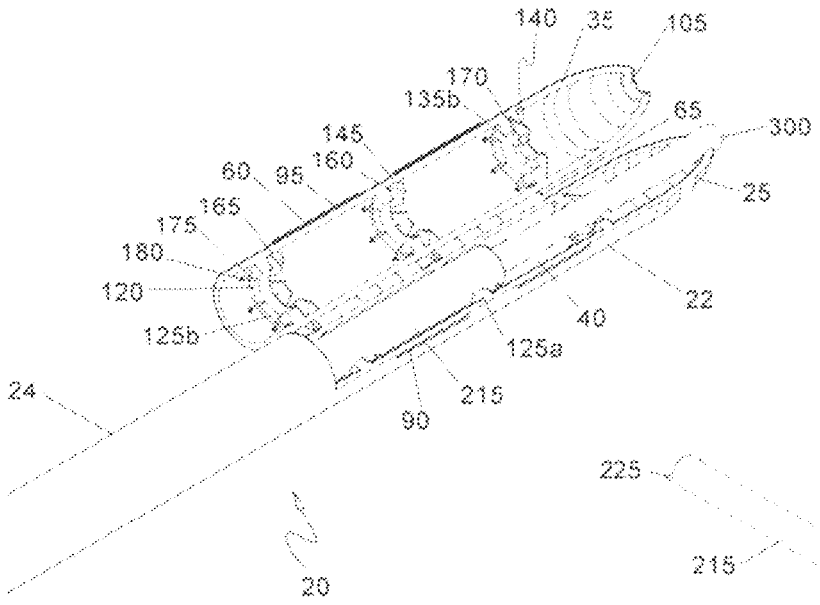
FIG. 3A illustrates the movement of the refill cartridge in accordance with the preferred embodiment of the present invention; and, FIG. 3B illustrates the internal extension of the refill cartridge in accordance with the preferred embodiment of the present invention.
Figure 3B:
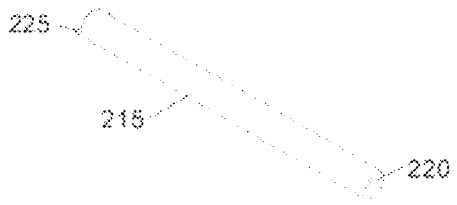

A displacement mechanism 200 is disposed within the helix cavity 45 as shown in FIG. 2B. The displacement mechanism 200 includes the push rod 215, a lead screw mechanism comprised of two intertwined helixes 205, and a stabilizer rod 225. The helixes 205 are formed by winding a bar around a cylinder at a uniform spacing. The bar may be composed of a metal, having a protective coating, or a plating, to resist corrosion, or a rigid thermoplastic to resist longitudinal deformation. Each full wrap of the bar around the cylinder represents a single flight 210. In a preferred embodiment, the helixes 205 are wrapped in a right hand direction, resulting in each turn of the displacement mechanism 200 in a clockwise direction, as viewed from the tail 30, causing the push rod 215 to be extended toward the tip 25 of the body 20. The intertwining of the helixes 205 results in a clearance space between each flight 210 into which the cylindrical stabilizer rod 225 is inserted. A pair of diametrically opposed keyways 230 are cut, or formed, into the sidewall 35 of the first body half 22 and the 20 second body half 24 running the full length of the helix cavity and projecting from the tail 30. The clearance face 155 is configured to comply with the curvature of the sidewalls 35 of the first body half 22 and the lid 60 as the push rod 215 pivotally displaces the 20 moveable segments 145 away from the rod support partition 120. The moveable segments 145 are aligned radially around the refill cavity 40 and the grooves 165 of the upright moveable segments 145 combine to make up a formed aperture 170 in which the refill cartridge 300 is cradled FIG. 3A and FIG. 3B illustrate the internal extension of the refill cartridge 300 and the movement of the refill cartridge 300 in accordance with the preferred embodiment of the present invention. As the refill cartridge 300 is advanced through the refill cavity 40 by the push rod 215 to compensate for a normal wear caused by usage, the push rod 215, having a larger cross-section 25 pivotally displaces the moveable segments 145 of the cartridge support aperture 140 to a configuration wherein the clearance face 155 is forced into contact with the sidewall 35 as shown in FIG. 3A.

The stabilizer rod 225 is attached to a first end of the cylindrical push rod 215 as depicted in FIG. 3B. An annular clamp ring 220 is attached to the second end of the push rod 215 as is also illustrated in FIG. 3B. The interior diameter of the clamp ring 220 is sized to retain the refill cartridge 300 in the multipurpose makeup applicator 10. The push rod 215 is inserted into the helix cavity 45 with the clamping ring 220 facing toward the refill cavity 40 to accept the posterior end of the refill cartridge 300. The stabilizer bar is engaged into the keyways 230 having each end confined within each keyway 230. The keyways 230 along each side of the helix cavity 45 inhibit any rotational movement of the push rod 215 as the helixes 205 are rotated. The helixes 205 are attached to a first end of the knob 235. The cylindrical knob 235 is composed of a molded thermoplastic material having some length which may be easily manipulated by a user to selective rotate the knob 235 along a longitudinal axis. The outside diameter of the knob 235 is approximately equal to the outer diameter, or maximum girth, of the body 20. The knob 235 may be provided with peripheral knurling or ridges in order to provide a more positive grip thereto. Disposed at the first end of the knob 235 is a ridge 240 configured to be slightly larger in diameter than the knob journal 190 previously discussed. A neck 245 configured to be a cylindrical portion of the knob adjacent to the ridge 240. The diameter of the neck 245 is configured to be slightly less than the knob journal 190. The knob 235, with the attached helixes 206, is configured to be inserted into the helix cavity 45 through the knob journal 190 at the tail 30 of the body 20. The ridge 240 is pressed through the knob journal 190 into the helix cavity 45 so that the neck 245 is retained within the knob journal 190. In this manner, the knob 235 is affixed to the body 20 and any subsequent rotation of the knob 235 results in the displacement of the stabilizer rod 225 within the gap of the helixes 205 to extend, or retract, the push rod 215, and ultimately the refill cartridge 300. Each turn of the knob 235 causes the stabilizer rod 225, the push rod 215, and the refill cartridge 300 to be displaced through a distance of one flight 210.

Method of Use of the Preferred Embodiment

The preferred embodiment of the present invention can be utilized by an enabled individual in a simple and straightforward manner with little or no training. After initial purchase or acquisition of the multipurpose makeup applicator 10, it would appear as indicated in FIG. 1. The method of utilizing the multipurpose makeup applicator 10 may be achieved by performing the following steps: acquiring a model of the multipurpose makeup applicator 10 having a desired style to suit the taste of the user; acquiring an applicable refill cartridge 300 to suit the purpose of the user; rotating the lid 60 to the open position 110; rotating the knob 235 so the clamp ring 220 at the first end of the push rod 215 is located within the cavity partition aperture 55; inserting the refill cartridge 300 into refill cavity 40, being sure to align the refill cartridge 300 with each formed aperture 170 of the cartridge support partitions 140 in the body first half 22; engaging the second end of the refill cartridge 300 into the clamp ring 220; rotating the lid 60 to the closed position 115; rotating the knob 235 in a direction which result in the extension of the refill cartridge 300 from the tip 25; and applying a cosmetic substance from the refill cartridge 300 to the appropriate location. In the event that an insufficient amount of the refill cartridge 300 extends from the tip 25 to continue to make a desirable application of the cosmetic substance, the knob 235 may be rotated additionally to further extend the refill cartridge 300. After the cosmetic substance has been applied, the refill cartridge 300 may be selectively retracted into the refill cavity 40 by rotating the knob 235 in an opposite direction.

When the refill cartridge 300 has been consumed, as evidenced by an inability to further rotate the knob 235, the refill cartridge 300 may be replaced by performing the following steps: rotating the knob 235 in a direction which results in the retraction of the push rod 215 completely into the helix cavity 45, thereby allowing all of the moveable segments 145 of the cartridge support partitions 140 to return to an upright position; rotating the lid 60 to the open position 110; rotating the knob 235 to advance the push rod 215 so that the clamp ring 220 is again located at the cavity partition aperture 55; removing any portion of the spent refill cartridge 300 which may exist from the body 20; properly disposing of that spent refill cartridge 300; inserting a new refill cartridge 300 as previously indicated; and rotating the lid 60 to the closed position 115.

Although an illustrative embodiment of the invention has been shown and described, it is to be understood that various modifications and substitutions may be made without departing from the novel spirit and scope of the present invention.

What is claimed:

1. A multi-purpose makeup applicator, comprising:

a pencil body, having a first body half and a second body half a refill cavity formed within an encircled sidewall of the first body half, a helix cavity formed within an encircled sidewall of the second body half where the refill cavity and helix cavity are separated by a cavity partition;

a lid hingedly attached to the first body half and terminates prior to the cavity partition where the second body half originates;

a displacement mechanism located in the helix cavity of the second body half; and wherein in the open position of the lid, a refill cartridge can be placed in the refill cavity, and through the displacement mechanism the refill cartridge moves relative to the refill cavity of the pencil body.

2. The multi-purpose makeup applicator of claim 1, wherein the first body half is configured to be a longitudinal half of the pencil body extending from a tip at an anterior end and a tail at a posterior end of the pencil body.

3. The multi-purpose makeup applicator of claim 1, wherein the pencil body is composed of a plurality of molded thermoplastic parts and is presented in a wide variety of colors and surface textures to suit the taste of a user.

4. The multi-purpose makeup applicator of claim 1, wherein the second body half is configured to be a longitudinal portion to a posterior portion of the first body half, extending from a midpoint of the pencil body to a tail and the second body half is attached to the first body half at the tail of the pencil body.

5. The multi-purpose makeup applicator of claim 1, wherein a knob journal is centrally located in a tail of the combined pencil body halves wherein the knob journal is an aperture into which a knob is inserted and retained.

6. The multi-purpose makeup applicator of claim 1, wherein the lid is a longitudinal half of a first end of the pencil body extending from a tip to a midway along the length of the pencil body.

7. The multi-purpose makeup applicator of claim 1, wherein the cavity partition is located in proximity to the longitudinal midpoint of the pencil body forming a rear barrier to the refill cavity and a forward barrier to the helix cavity.

8. The multi-purpose makeup applicator of claim 1, wherein the cavity partition further comprises:

a centrally disposed cavity partition aperture to provide communication between the refill cavity and the helix cavity.

9. The multi-purpose makeup applicator of claim 1, wherein at least one latch is disposed along an exterior face of the pencil body opposite from the hinges to retain the lid in the closed position.

10. The multi-purpose makeup applicator of claim 7, wherein a latch is configured to be a second catch projecting from the edge of the lid which envelops and interferes with a first catch projecting from the sidewall of the first body half.

11. The multi-purpose makeup applicator of claim 7, wherein in the closed position a user detaches a second catches from a first catches and pivots the lid about one or more hinge pins in order to configure a device to an open position, in order to insert or remove the refill Cartridge.

12. The multi-purpose makeup applicator of claim 1, wherein an anterior end of the first body half is provided with a first segment tip aperture configured to be a groove in a sidewall of a tip; and a second segment tip aperture is disposed in the anterior end of the lid; and wherein in the closed position, first and the second tip aperture segments align to form a circular opening in the tip through which a cylindrical refill cartridge projects.

13. The multi-purpose makeup applicator of claim 1, where the refill cavity further comprises of:

one or more rod support partitions configured to be structural partition provided with a support partition aperture through which a cylindrical push rod can be extended to advance the refill cartridge, and wherein the push rod extends from the helix cavity through a cavity partition aperture; and a cartridge support partition located at an anterior face of each rod support partition;

wherein the cartridge support partitions align a smaller diameter refill cartridge in the refill cavity;

wherein the cartridge support partitions are configured to be divided into one or more movable segments which are temporarily displaced as the push rod traverses the refill cavity.

14. The multi-purpose makeup applicator of claim 11, further comprising moveable segments, the moveable segments comprising:

the same constituent material as the pencil body with a planar rear face in contact with a cartridge support partition;

an arcuate groove formed along a perpendicular face directed toward the center of the refill cavity, and an angularly curved clearance face; and wherein the clearance face is configured to comply with the curvature of the sidewalls of the first body half and the lid as a push rod pivotally displaces the moveable segments away from a rod support partition.

15. The multi-purpose makeup applicator of claim 11, further comprising moveable segments, the moveable segments comprising:

a return spring, wherein the return spring is attached at a first end to a rear face of each moveable segment to exert a righting force when a push rod is retracted into the helix cavity.

16. The multi-purpose makeup applicator of claim 13, wherein a return spring is configured to be a resilient elastomeric filament which in a contracted state, retains a rear face in contact with the rod support partition.

17. The multi-purpose makeup applicator of claim 13, wherein a return spring is routed through a spring aperture into the one or more rod support partitions and anchored at a second end to a respective proximate sidewall by means of a restrictive stay; and wherein the stay is configured to be a pair of internal projections from the sidewall placed in close proximity to each other such that a retentive constrictive force is placed on the return spring.

18. The multi-purpose makeup applicator of claim 1, where the displacement mechanism further comprises:

a cylindrical push rod;

a lead screw mechanism comprised of one or more intertwined helixes;

a stabilizer rod;

wherein the stabilizer rod is attached to a first end of the cylindrical push rod and an annular clamp ring is attached to a second end of the push rod, where the interior diameter of the clamp ring is sized to retain the refill cartridge in a device, and the cylindrical push rod is inserted into the helix cavity with the clamp ring facing toward the refill cavity to accept a posterior end of the refill cartridge;

wherein the intertwining of the helixes causes a clearance space between each flight into which a cylindrical stabilizer rod is inserted; and wherein the helixes are formed by winding a bar around a cylinder at a uniform spacing and the helixes are wrapped in a right hand direction, resulting in each turn of the displacement mechanism in a clockwise direction, causing the push rod to be extended toward a tip of the pencil body.

19. A method of utilizing the multi-purpose makeup applicator of claim 18 comprising:

means for acquiring an applicable refill cartridge to suit the purpose of a user;

rotating the lid to an open position;

rotating a knob such that a clamp ring at a first end of the push rod is located within a cavity partition aperture;

inserting the refill cartridge into the refill cavity;

aligning the refill cartridge within a formed aperture of cartridge support partitions in a body first half;

engaging a second end of the refill cartridge into the clamp ring;

rotating the lid to a closed position;

rotating the knob in a direction resulting in the extension of the refill cartridge from a tip; and applying a cosmetic substance from the refill cartridge to an appropriate location.

20. A method of utilizing the multi-purpose makeup applicator of claim 5 to replace the refill cartridge comprising:

rotating the knob in a direction which results in the retraction of a push rod completely into the helix cavity, allowing moveable segments of cartridge support partitions to return to an upright position;

rotating the lid to an open position;

rotating the knob to advance the push rod such that a clamp ring is located at a cavity partition aperture;

removing any portion of an existing old refill cartridge from the pencil body;

disposing of the old refill cartridge;

inserting a new refill cartridge into the refill cavity;

aligning the new refill cartridge within a formed aperture of the cartridge support partitions in the first body half;

engaging a second end of the new refill cartridge into the clamp ring; rotating the lid to a closed position.

* * * * *